US008721475B2

(12) United States Patent
Shiga et al.

(10) Patent No.: US 8,721,475 B2
(45) Date of Patent: May 13, 2014

(54) GOLF BALL AND METHOD FOR PRODUCING THE SAME

(75) Inventors: Kazuyoshi Shiga, Kobe (JP); Toshiyuki Tarao, Kobe (JP); Keiji Ohama, Kobe (JP)

(73) Assignee: SRI Sports Limited, Kobe (JP)

( * ) Notice: Subject to any disclaimer, the term of this patent is extended or adjusted under 35 U.S.C. 154(b) by 617 days.

(21) Appl. No.: 12/909,910

(22) Filed: Oct. 22, 2010

(65) Prior Publication Data

US 2011/0105246 A1 May 5, 2011

(30) Foreign Application Priority Data

Oct. 29, 2009 (JP) ..... 2009-248651

(51) Int. Cl.
*A63B 37/06* (2006.01)

(52) U.S. Cl.
USPC ..... 473/378

(58) Field of Classification Search
USPC ..... 473/378, 351
See application file for complete search history.

(56) References Cited

U.S. PATENT DOCUMENTS

| | | | | |
|---|---|---|---|---|
| 6,794,447 | B1 | 9/2004 | Kim et al. | |
| 7,332,533 | B2 | 2/2008 | Kim et al. | |
| 2004/0092336 | A1 | 5/2004 | Kim et al. | |
| 2005/0059756 | A1 | 3/2005 | Kim et al. | |
| 2005/0170910 | A1 | 8/2005 | Hayashi | |
| 2006/0194649 | A1 | 8/2006 | Hayashi | |
| 2006/0194650 | A1 | 8/2006 | Hayashi | |
| 2008/0214326 | A1 | 9/2008 | Kim et al. | |
| 2008/0293518 | A1* | 11/2008 | Shiga et al. | 473/378 |
| 2009/0264223 | A1* | 10/2009 | Tarao | 473/378 |

FOREIGN PATENT DOCUMENTS

| | | | |
|---|---|---|---|
| JP | 2004-504900 | A | 2/2004 |
| JP | 2005-218858 | A | 8/2005 |
| JP | 2006-43447 | A | 2/2006 |
| JP | 2006-43448 | A | 2/2006 |
| JP | 2006-95286 | A | 4/2006 |
| JP | 2006-95287 | A | 4/2006 |
| JP | 2006-230661 | A | 9/2006 |
| JP | 2007-167257 | A | 7/2007 |
| JP | 2008-289674 | A | 12/2008 |

* cited by examiner

*Primary Examiner* — Raeann Gorden
(74) *Attorney, Agent, or Firm* — Birch, Stewart, Kolasch & Birch, LLP

(57) ABSTRACT

An object of the present invention is to provide a novel golf ball that controls the spin rate on the approach shots while suppressing the change in the spin rate on the driver shots and a method for producing the same. The present invention provides a golf ball having a cover containing a resin component and a filler, wherein the filler is oriented roughly parallel to a surface of the cover. The cover having anisotropy behaves like a hard material against the deformation in the compression direction on the driver shots and behaves like a soft material against the deformation in the shear direction on the approach shots. The present invention also provides a method for producing a golf ball, comprising compression molding a cover composition containing a resin component and a filler to mold a shell, and compression molding a core covered with a plurality of shells to mold a cover.

18 Claims, 4 Drawing Sheets

2009R2701202.tif
R270-12
12
Print Mag: 17600x @ 7.0 in
13:38 03/13/09

500 nm
HV=100.0kV
Direct Mag: 10000x
AMT Camera System

GOLF BALL AND METHOD FOR PRODUCING THE SAME

FIELD OF THE INVENTION

The present invention relates to a technology for improving a golf ball cover.

DESCRIPTION OF THE RELATED ART

Ionomer resins and polyurethanes are used as a resin component for forming a golf ball cover. Ionomer resins have high rigidity, and if ionomer resins are used as a constituting member of a golf ball, a golf ball traveling a great distance is obtained. Therefore, ionomer resins are widely used as a material of an intermediate layer or a cover constituting a golf ball. Polyurethanes are flexible, and if polyurethanes are used as a cover material of a golf ball, a golf ball having excellent spin performance and shot feeling is obtained.

There are proposals to improve the performance of a golf ball by blending fillers, such as organic short fibers, metal, and clay minerals, into a constituting member of the golf ball. For example, Japanese Patent Publication Nos. 2006-043447 A and 2006-043448 A disclose a golf ball which has a core and an outer layer portion surrounding the core, and the outer layer portion is formed from a resin composition which contains a cation treated layered silicate in a resin matrix. Japanese Patent Publication Nos. 2006-095286 A and 2006-095287 A disclose a golf ball which has a core, an intermediate layer covering the core, and a cover layer covering the intermediate layer, wherein the intermediate layer is formed from a resin composition which contains a cation treated layered silicate. Japanese Publication No. 2004-504900 T discloses a golf ball containing a nanocomposite material that is made of a polymer having a structure in which particles of inorganic materials are reacted and substantially evenly dispersed, in which each particle has a largest dimension that is about one micrometer or less and that is at least an order of magnitude greater than such particle's smallest dimension.

SUMMARY OF THE INVENTION

It is an ultimate goal for those who develop golf balls to provide a golf ball traveling a great distance on driver shots, and stopping quickly on the green on approach shots. The golf ball should have a low spin rate on the driver shots in order to travel a great distance and should have a high spin rate on the approach shots in order to stop quickly on the green. In the conventional improvements of golf balls, an attempt to increase the spin rate on the approach shots also increases the spin rate on the driver shots. Therefore, it has been difficult to strike a balance between traveling a long distance on the driver shots and stopping quickly on the green an approach shots. The present invention has been achieved in view of the above circumstances. An object of the present invention is to provide a novel golf ball that controls the spin rate on the approach shots while suppressing the change in the spin rate on the driver shots. Another object of the present invention is to provide a golf ball which has a high spin rate on the approach shots and a low spin rate on the driver shots.

The inventors of the present invention has addressed the above described problem, and achieved the present invention based on the findings that the regulation of the orientation of the filler in the cover controls the spin rate on the approach shots while suppressing the change in the spin rate on the driver shots in a golf ball having a cover containing a resin component and a filler. The present invention that has solved the above described problem provides a golf ball having a cover containing a resin component and a filler, wherein the filler is oriented roughly parallel to a surface of the cover. Since the filler is oriented roughly parallel to the surface of the cover, the cover has anisotropy. Thus, it is thought that the cover shows the behavior of a hard material against the deformation in a compression direction on a driver shot, and the cover shows the behavior of a soft material against the deformation in a shear direction on an approach shot.

The present invention also provides a method for producing a golf ball, comprising compression molding a cover composition containing a resin component and a filler to mold a shell, and compression molding a core covered with a plurality of shells to mold a cover. The filler in the cover is oriented roughly parallel to a surface of the cover by forming the shells by compression molding the cover composition containing the resin component and the filler.

According to the present invention, a golf ball which can suppress a change in the spin rate on a driver shot and also can control the spin rate on an approach shot, is obtained. According to the present invention, a golf ball having a high spin rate on an approach shot and a low spin rate on a driver shot, is obtained.

DESCRIPTION OF THE PREFERRED EMBODIMENT

Figure 1:
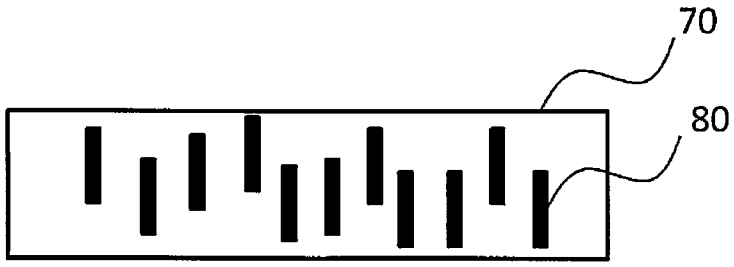
FIG. 1 is a cross sectional view of the cover schematically showing an orientation of the flake-like filler in the cover.

The present invention is directed to a golf ball having a cover containing a resin component and a filler, wherein the filler is oriented roughly parallel to a surface of the cover. First, the filler used in the present invention will be explained. The filler used in the present invention includes, for example, a flake-like filler, needle-like filler or fibrous filler. The fillers having different shapes may be used in combination. Among them, the flake-like filler is preferably used in the present invention.

The flake-like filler includes, for example, a glass flake, a calcium carbonate flake, an aluminum flake, a layered silicate, or an organically modified layered silicate. In the present invention, the layered silicate or organically modified layered silicate is preferably used as the flake-like filler.

The layered silicate is a silicate having a layered structure. The organically modified layered silicate is a layered silicate, in which a part or all of the metallic cations that are intrinsically contained within a layered silicate crystal interlayer are exchanged with organic cations. In the present invention, a layered silicate that is not organically modified is simply referred to as a "layered silicate", and a layered silicate that is organically modified is called an "organically modified layered silicate".

The layered silicate is not limited, as long as it is a silicate that has a layered structure. Examples are: layered silicates of kaolinites such as kaolinite, dickite, halloysite, chrysotile, lizardite, and amesite; layered silicates of smectites such as montmorillonite, beidellite, nontronite, saponite, ferrous saponite, hectorite, sauconite, and stevensite; layered silicates of vermiculites such as dioctahedral vermiculite, and trioctahedral vermiculite; layered silicates of micas such as muscovite, paragonite, phlogopite, biotite, and lepidolite; layered silicates of brittle micas such as margarite, clintonite, and anandite; layered silicates of chlorites such as cookeite, sudoite, clinochlore, chamosite, and nimite. These layered silicates may be natural or synthetic in origin, and may be used solely or as a mixture of two or more types. Among these, layered silicates of smectites such as montmorillonite, beidellite, nontronite, saponite, ferrous saponite, hectorite, sauconite, and stevensite; and layered silicates of vermiculites such as dioctahedral vermiculite, and trioctahedral vermiculite; are preferred as a layered silicate to be used in the present invention. Among these, montmorillonite is especially preferred.

Each layer (primary particle) that constitutes the layered silicate is preferably a nano size fine particle with a thickness of 10 nm or less, and preferably has a flat shape with a length of 1 μm or less, and a width of 1 μm or less. There is no limitation on the size of the layered silicate, however, the size is preferably 1 μm or less, more preferably 700 nm or less, and even more preferably 500 nm or less.

A cation exchange capacity of the layered silicate is preferably 30 meq/100 g or more, more preferably 40 meq/100 g or more, and even more preferably 50 meq/100 g or more, and is preferably 200 meq/100 g or less, more preferably 180 meq/100 g or less, and even more preferably 160 meq/100 g or less. If the cation exchange capacity is 30 meq/100 g or more, a sufficient exchange of an organic cation is achieved during organic modification, and the interlayer distance may be widened to a desired width. If the cation exchange capacity is 200 meq/100 g or less, bonding force in the crystal interlayer is not excessively strong, and the interlayer distance may be easily widened. The cation exchange capacity is an amount of exchangeable cation contained in a layered silicate per unit mass of the layered silicate.

An organic cation used during organic modification of the layered silicate is a cation that has a carbon chain. The organic cation is not limited, and examples include an organic ammonium ion, an organic phosphonium ion, and an organic sulfonium ion.

The carbon number of the carbon chain included in the organic cation is preferably 3 or more, more preferably 4 or more, and even more preferably 5 or more, and is preferably 50 or less, more preferably 40 or less, and even more preferably 30 or less. If the carbon number of the carbon chain included in the organic cation is in a range from 3 to 50, the interlayer distance of the layered silicate may be widened to a desired width during organic modification. The interlayer distance of the organically modified layered silicate is basically dependent on the length of the carbon chain included in the organic cation, and therefore, the carbon number of the carbon chain included in the organic cation may be altered as appropriate, depending on the desired interlayer distance.

Examples of the organic ammonium ion include: primary ammonium ions, such as stearyl ammonium ion, hexyl ammonium ion, octyl ammonium ion, and 2-ethyl hexyl ammonium ion; secondary ammonium ions such as dodecyl (lauryl) ammonium ion, and octadecyl (stearyl) ammonium ion; tertiary ammonium ions such as trioctyl ammonium ion; and quaternary ammonium ions such as dioctyl dimethyl ammonium ion, and distearyl dimethyl ammonium ion. Examples of the organic phosphonium ion include stearyl phosphonium ion and the like. Examples of the organic sulfonium ion include stearyl sulfonium ion and the like. These organic cations may be used solely, or in combination of two or more types.

A salt of the organic cation may be used as a source of the organic cation. For example, when stearyl ammonium is used as the organic cation, for example, stearylamine hydrochloride may be used as a source, and when distearyl dimethyl ammonium is used as the organic cation, for example, distearyl dimethyl ammonium chloride may be used as a source. The method for organic modification is described later.

An ion exchange rate of the organically modified layered silicate is preferably 50 mol % or higher, and more preferably 60 mol % or higher, and even more preferably 70 mol % or higher. If the ion exchange rate of the organically modified layered silicate is 50 mol % or higher, the dispersibility of the organically modified layered silicate in the resin component is improved. Herein, an ion exchange rate of the organically modified layered silicate is, a ratio (mole percentage) of an amount of cations that are exchanged with an organic cation, to the total amount of exchangeable cations contained within a layered silicate before organic modification.

Specific examples of the organically modified layered silicate includes "Dellite (registered trade mark) 43B (purified montmorillonite, particle size: 500 nm, thickness: 1 nm, quaternary ammonium salt treatment: quaternary ammonium salt with benzyl group, tallowate group, two methyl groups)", "Dellite (registered trade name) 67 G (purified montmorillonite, particle size: 500 nm, thickness: 1 nm, quaternary ammonium salt treatment: quaternary ammonium salt with two tallowate groups, two methyl groups), available from Laviosa Chimica Mineraria S.p.A. and "S-BEN" available from HOJUN Co., Ltd.

Examples of the needle-like filler for use in the present invention are inorganic whiskers such as a potassium titanate whisker, a graphite whisker, an alumina whisker, a silicon carbide whisker, a silicon nitride whisker, a mullite whisker, a magnesia whisker, a magnesium borate whisker, a zinc oxide whisker, and a titanium boride whisker. These needle-like fillers may be used alone or two or more of them may be used in combination.

Examples of the fibrous filler for use in the present invention are natural fibers of kenaf, cotton, flax plant, sheep wool, silk, feather, or asbestos; synthetic fibers such as a nylon fiber, a vinylon fiber, an acrylic fiber, a polyester fiber, a polyolefin fiber, and a polyurethane fiber; inorganic fibers such as a glass fiber, a carbon fiber, an alumina fiber, a potassium titanate fiber, a basic magnesium sulfate fiber, and a calcium carbonate fiber; natural mineral fibers such as wallastonite ($CaO—SiO_2$) and fibrous brucite ($Mg(OH)_2$); and a metal fiber. These fibrous fillers may be used alone or in combination of at least two of them. Further, the needle-like fillers and the fibrous fillers may be used in combination.

The average length of the needle-like and fibrous filler is preferably 1 μm or longer, more preferably 2 μm or longer, and even more preferably 5 μm or longer. The average length of the needle-like and fibrous filler is preferably 2,000 μm or shorter, and more preferably 1,500 μm or shorter. If the average length of the needle-like and fibrous filler is shorter than 1 μm, the durability of the golf ball may not be improved and if the average length exceeds 2,000 μm, the appearance of the golf ball may become poor.

Further, the average aspect ratio of the needle-like and fibrous filler is preferably 10 or higher, and more preferably 15 or higher. The average aspect ratio is preferably 100 or lower, and more preferably 50 or lower. If the average aspect ratio of the needle-like and fibrous filler is less than 10, the durability of the golf ball may not be improved and if the average aspect ratio exceeds 100, the appearance of the golf ball may become poor.

The average length of the needle-like and fibrous filler in the present invention means an average value of the length in the longitudinal direction of the needle-like or fibrous filler and the average aspect ratio means the ratio of the average length to the average diameter of the needle-like or fibrous filler (average length/average diameter).

In the present invention, the resin component constituting the cover is not limited. Examples of the resin components include polyurethane, an ionomer resin, polyamide, polyester, or a mixture thereof. In the present invention, polyurethane is preferably used as the main resin component constituting the cover. The content of the polyurethane in the resin component is preferably 50 mass % or more, more preferably 70 mass % or more, even more preferably 90 mass % or more. In a more preferable embodiment, the resin component essentially consists of polyurethane. Use of the soft polyurethane as the resin component provides the golf ball with a high spin rate on the approach shots.

The polyurethane used as the resin component of the cover is not limited, as long as it has a plurality of urethane bonds in the molecule thereof, and includes, for example, a product having the urethane bonds in the molecule thereof, formed by a reaction between a polyisocyanate and a polyol. Further, the chain extending reaction with a chain extender such as a low molecular weight polyamine or low molecular weight polyol may be conducted where necessary. The polyurethane used in the present invention may be either thermoplastic polyurethane or thermosetting polyurethane (two-component curing type polyurethane). In the present invention, the thermoplastic polyurethane is preferable.

The polyisocyanate component constituting the polyurethane used in the present invention is not limited, as long as it has at least two isocyanate groups. Examples of the polyisocyanate include an aromatic polyisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylenediisocyanate (TMXDI), para-phenylene diisocyanate (PPDI); an alicyclic polyisocyanate or aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI). These may be used either alone or as a mixture of at least two of them.

In view of improving the abrasion-resistance, the aromatic polyisocyanate is preferably used as the polyisocyanate component of the polyurethane. Use of the aromatic polyisocyanate improves the mechanical property of the obtained polyurethane and provides the cover with the excellent abrasion-resistance. In addition, in view of improving the weather resistance, as the polyisocyanate component of the polyurethane, a non-yellowing type polyisocyanate such as TMXDI, XDI, HDI, $H_6$XDI, IPDI, $H_{12}$MDI and NBDI is preferably used. More preferably, 4,4'-dicyclohexylmethane diisocyanate ($H_{12}$MDI) is used. Since 4,4'-dicyclohexylmethane diisocyanate ($H_{12}$MDI) has a rigid structure, the mechanical property of the resulting polyurethane is improved, and thus the cover which is excellent in abrasion-resistance can be obtained.

The polyol component constituting the polyurethane is not particularly limited as long as it has a plurality of hydroxyl groups, and such examples include a low-molecular weight polyol that is used for example as a chain extender and a polymer polyol that constitutes a soft segment. Examples of the low-molecular weight polyol include a diol such as ethylene glycol, diethylene glycol, triethylene glycol, propanediol, dipropylene glycol, 1,3-butanediol, 1,4-butanediol, neopentyl glycol, 1,6-hexanediol; a triol such as glycerin, trimethylol propane, and hexanetriol. Examples of the polymer polyol include a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ϵ-caprolactone (PCL); a polycarbonate polyol such as polyhexamethylene carbonate; and an acrylic polyol. The above polyols may be used alone or as a mixture of at least two of them.

A number average molecular weight of the polymer polyol is not particularly limited, and for example, it is preferably 400 or more, more preferably 1,000 or more. If the number average molecular weight of the polymer polyol is too small, the resultant polyurethane becomes hard and the shot feeling of the golf ball deteriorates. The upper limit of the number average molecular weight of the polymer polyol is not particularly limited, and it is preferably 10,000, more preferably 8,000.

The polyamine component that constitutes the polyurethane where necessary may include any polyamine, as long as it has at least two amino groups. The polyamine includes an aliphatic polyamine such as ethylenediamine, propylenediamine, butylenediamine, and hexamethylenediamine, an alicyclic polyamine such as isophoronediamine, piperazine, and an aromatic polyamine such as phenylenediamine, tolylenediamine, diethyltoluenediamine, and dimethylthiotoluenediamine, xylylenediamine, and diphenylmethanediamine.

The polyurethane has no limitation on the constitutional embodiments thereof. Examples of the constitutional embodiments are the embodiment where the polyurethane consists of the polyisocyanate component and the polymer polyol component; the embodiment where the polyurethane consists of the polyisocyanate component, the polymer polyol component and the low-molecular weight polyol component; and the embodiment where the polyurethane consists of the polyisocyanate component, the polymer polyol component, the low-molecular weight polyol component, and the polyamine component; and the embodiment where the polyurethane consists of the polyisocyanate component, the polymer polyol component and the polyamine component. Examples of the polyurethane include "Elastollan XNY90A", "Elastollan XNY97A", "Elastollan 585" commercially available from BASF Japan Ltd.

In the present invention, ionomer resins or other thermoplastic elastomers can be used as the resin component constituting the cover.

Specific examples of the ionomer resins include trade name "Himilan (registered trademark) (e.g. the binary copolymerized ionomer such as Himilan 1555 (Na), Himilan 1557 (Zn), Himilan 1605 (Na), Himilan 1706 (Zn), Himilan 1707 (Na), Himilan AM7311 (Mg), Himilan AM7329 (Zn); and the ternary copolymerized ionomer such as Himilan 1856 (Na), Himilan 1855 (Zn))" commercially available from Du Pont-Mitsui Polychemicals Co., Ltd.

Further, examples include "Surlyn (registered trademark) (e.g. the binary copolymerized ionomer such as Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li); and the ternary copolymerized ionomer such as Surlyn 6320 (Mg), Surlyn 8120 (Na), Surlyn 8320 (Na), Surlyn 9320 (Zn))" and the ternary copolymerized ionomer such as "HPF 1000 (Mg), HPF 2000 (Mg)" commercially available from E.I. du Pont de Nemours and Company.

Further, examples include "Iotek (registered trademark) (e.g. the binary copolymerized ionomer such as Iotek 8000 (Na), Iotek 8030 (Na), Iotek 7010 (Zn), Iotek 7030 (Zn); and the ternary copolymerized ionomer such as Iotek 7510 (Zn), Iotek 7520 (Zn))" commercially available from ExxonMobil Chemical Corporation. It is noted that Na, Zn, Li, and Mg described in the parentheses after the trade names indicate metal types of neutralizing metal ions for the ionomer resins. The ionomer resins can be used solely or as a mixture of at least two of them.

Specific examples of the thermoplastic elastomers are a thermoplastic polyamide elastomer having a commercial name of "Pebax (registered trademark) (e.g. "Pebax 2533")" commercially available from Arkema K. K.; a thermoplastic polyester elastomer having a commercial name of "Hytrel (registered trademark) (e.g. "Hytrel 3548", "Hytrel 4047")" commercially available from Du Pont-Toray Co., Ltd.; a thermoplastic polystyrene elastomer having a commercial name of "Rabalon (registered trademark) (e.g. "Rabalon T3221C")" commercially available from Mitsubishi Chemical Corporation.

The golf ball of the present invention has no limitation on the golf ball construction, as long as it has a core and cover. Specific examples include a two-piece golf ball comprising a single-layered core and a cover disposed around the core, a three-piece golf ball comprising a core having a center and a single-layered intermediate layer disposed around the center, and a cover disposed around the core, and a multi-piece golf ball comprising a core having a center and at least two intermediate layer disposed around the center, and a cover disposed around the core.

The cover of the golf ball of the present invention contains a resin component and a filler. The content of the filler is preferably 10 parts or more, more preferably 15 parts or more, even more preferably 20 parts or more, and is preferably 100 parts or less, more preferably 80 parts or less, even more preferably 60 parts or less with respect to 100 parts of the resin component by mass. If the content is 10 parts by mass or more, since it is possible to impart the orientation to the cover, the spin rate on the driver shots become low. If the content is 100 parts by mass or less, it is possible to keep the abrasion resistance at a high level.

The cover of the golf ball of the present invention preferably has a slab hardness of 5 or more, more preferably 10 or more, even more preferably 20 or more, even more preferably 30 or more, and preferably has a slab hardness of 80 or less, more preferably 75 or less, even more preferably 70 or less, even more preferably 60 or less in Shore D hardness. If the slab hardness of the cover is less than 5, the repulsion property of the golf ball may be lowered, resulting in the short flight distance, while if the cover hardness is more than 80, the durability of the obtained golf ball may be lowered. Herein, the slab hardness of the cover is a measured hardness of the cover composition that is molded into a sheet form. Sheets having a thickness of about 2 mm are prepared from the cover composition by hot press molding and preserved at the temperature of 23° C. for two weeks. Three or more of the sheets are stacked on one another to avoid being affected by the measuring substrate on which the sheets are placed, and the stack is subjected to the measurement using a hardness tester provided with the Shore D type spring hardness tester prescribed by ASTM-D2240

The cover of the golf ball of the present invention may contain a pigment component such as a white pigment (for example, titanium oxide) and a blue pigment, a gravity adjusting agent such as calcium carbonate and barium sulfate, a dispersant, an antioxidant, an ultraviolet absorber, a light stabilizer, a fluorescent material or a fluorescent brightener.

The content of the white pigment (for example, titanium oxide) is preferably 0.5 part by mass or more, more preferably 1 part by mass or more, and is preferably 10 parts by mass or less, more preferably 8 parts by mass or less based on 100 parts by mass of the resin component. The white pigment in an amount of 0.5 part by mass or more can impart opacity to the cover, while the white pigment in an amount of more than 10 parts by mass may lower the durability of the cover.

In the golf ball of the present invention, the filler in the cover is oriented roughly parallel to the surface of the cover. Since the filler is oriented roughly parallel to the surface of the cover, the cover shows anisotropic behavior. That is, the cover is considered to show behavior like a hard material against the deformation in the compression direction on the driver shots and behavior like a soft material against the deformation in the shear direction on the approach shots. In the case of using the flake-like filler, it is preferable that the face of the flake-like filler is oriented roughly parallel to the surface of the cover. In the case of using the needle-like filler or fibrous filler, it is preferable that the long direction of the needle-like filler or fibrous filler is oriented roughly parallel to the surface of the cover.

Figure 2:
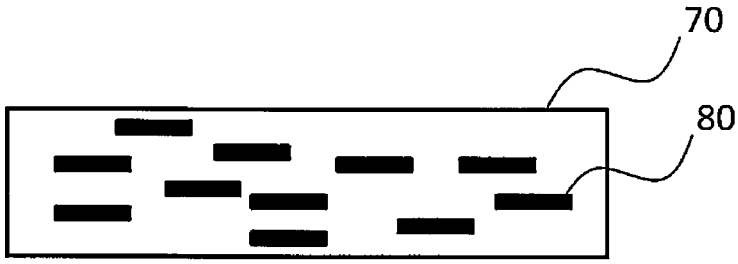
FIG. 2 is a cross sectional view of the cover schematically showing an orientation of the flake-like filler in the cover.
Figure 3:
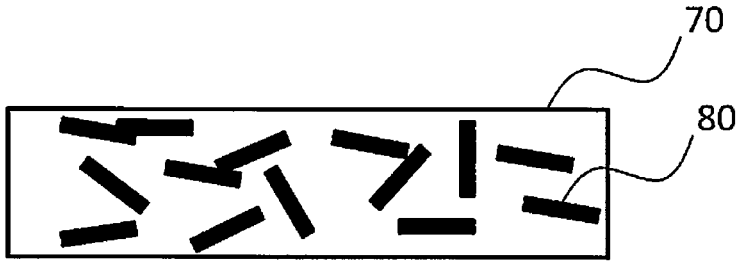
FIG. 3 is a cross sectional view of the cover schematically showing an orientation of the flake-like filler in the cover.

The orientation degree of the filler in the cover can be determined as follows, on the basis of a measurement result of an infrared absorption spectrum (reference: V. C. FATMER and J. D. RUSSELL, Spectorochimica Acta 1964, 20, 1149-117). FIGS. 1 to 3 are cross-sectional views of covers for schematically illustrating the orientation of the flake-like filler in a cover. As shown in FIG. 1, when the flake-like filler 80 in the cover is oriented perpendicularly to a cover surface 70, the absorbance (A1100) at 1100 $cm^{-1}$ is high. On the other hand, as shown in FIG. 2, when the flake-like filler 80 is oriented roughly parallel to the cover surface 70, the absorbance (A1100) at 1100 $cm^{-1}$ is low. Moreover, when the flake-like filler 80 is present in a non-orientation state in the cover as shown in FIG. 3, the absorbance (A1030) at 1030 $cm^{-1}$ is high. In the present invention, the ratio (A1100/A1030) of the absorbance (A1100) at 1100 $cm^{-1}$ to the absorbance (A1030) at 1030 $cm^{-1}$ in an infrared spectrum, is defined as an orientation degree. In the present invention, the orientation degree is preferably 1.3 or less, and more preferably 1.0 or less. If the orientation degree is 1.3 or less, a cover which has a low spin on driver shots and a high spin on approach shots, is obtained. The lower limit of the orientation degree is not particularly limited to a specific value, as long as it is more than 0.

In the present invention, the thickness of the cover of the golf ball is preferably 2.0 mm or less, more preferably 1.5 mm or less, even more preferably 1.0 mm or less. If the thickness of the cover is 2.0 mm or less, since it is possible to increase the diameter of the core, the resilience of the obtained golf ball is improved. The lower limit of the thickness of the cover is preferably, but not limited to, 0.3 mm, more preferably 0.4 mm, and even more preferably 0.5 mm. If the thickness of the cover is less than 0.3 mm, it may become difficult to mold the cover.

Next, a preferred embodiment of the core of the golf ball of the present invention will be explained. The core of the golf ball of the present invention includes, for example, a single-layered core, a core consisting of a center and a single-layered intermediate layer covering the center; and a core consisting of a center and multi-piece or multi-layer of intermediate layers covering the center. The core preferably has a spherical shape. If the core does not have a spherical shape, the cover does not have a uniform thickness. As a result, there exist some portions where the performance of the cover is lowered. On the other hand, the center generally has the spherical shape, but the center may be provided with a rib on the surface thereof so that the surface of the spherical center is divided by the ribs, preferably the surface of the spherical center is evenly divided by the ribs. In one embodiment, the ribs are preferably formed as a part of the center in an integrated manner on the surface of the center, and in another embodiment, the ribs are formed as an intermediate layer on the surface of the spherical center.

The ribs are preferably formed along an equatorial line and meridians that evenly divide the surface of the spherical center, if the spherical center is assumed as the earth. For example, if the surface of the spherical center is evenly divided into 8, the ribs are formed along the equatorial line, any meridian as a standard, and meridians at the longitude 90 degrees east, longitude 90 degrees west, and the longitude 180 degrees east (west), assuming that the meridian as the standard is at longitude 0 degree. If the ribs are formed, the depressed portion divided by the ribs are preferably filled with a plurality of it layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

The core or the center of the golf ball of the present invention, is preferably obtained by, for example, heat-pressing a rubber composition (hereinafter, sometimes simply referred to as "core rubber composition") containing a base rubber, a crosslinking initiator, a co-crosslinking agent, and where necessary a filler.

As the base rubber, a natural rubber or a synthetic rubber can be used. Such examples include a polybutadiene rubber, a natural rubber, a polyisoprene rubber, a styrene polybutadiene rubber, and ethylene-propylene-diene terpolymer (EPDM). Among them, typically preferred is the high cis-polybutadiene having cis-1,4 bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.2 part by mass or more, more preferably 0.3 part by mass or more, and is preferably 3 parts by mass or less, more preferably 2 parts by mass or less based on 100 parts by mass of the base rubber. If the amount is less than 0.2 part by mass, the core becomes too soft, and the resilience tends to be lowered, and if the amount is more than 3 parts by mass, the amount of the co-crosslinking agent needs to be increased in order to obtain an appropriate hardness, which may cause the insufficient resilience.

The co-crosslinking agent is not particularly limited, as long as it has the effect of crosslinking a rubber molecule by graft polymerization to a base rubber molecular chain. For example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high resilience.

The amount of the co-crosslinking agent to be used is preferably 10 parts or more, more preferably 20 parts or more, and is preferably 50 parts or less, more preferably 40 parts or less based on 100 parts of the base rubber by mass. If the amount of the co-crosslinking agent to be used is less than 10 parts by mass, the amount of the organic peroxide must be increased to obtain an appropriate hardness which tends to lower the resilience. On the other hand, if the amount of the co-crosslinking agent to be used is more than 50 parts by mass, the core becomes too hard, so that the shot feeling may be lowered.

The filler contained in the core rubber composition is mainly blended as a gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 2 parts or more, more preferably 3 parts or more, and is preferably 50 parts or less, more preferably 35 parts or less based on 100 parts of the base rubber by mass. If the amount of the filler to be blended is less than 2 parts by mass, it becomes difficult to adjust the weight, while if it is more than 50 parts by mass, the weight ratio of the rubber component becomes small and the resilience tends to be lowered.

As the core rubber composition, an organic sulfur compound, an antioxidant or a peptizing agent may be blended appropriately in addition to the base rubber, the crosslinking initiator, the co-crosslinking agent and the filler.

As the organic sulfur compound, a diphenyl disulfide or a derivative thereof may be preferably used. Examples of the diphenyl disulfide or the derivative thereof include diphenyl disulfide; a mono-substituted diphenyl disulfide such as bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide and bis(4-cyanophenyl)disulfide; a di-substituted diphenyl disulfide such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, and bis(2-cyano-5-bromophenyl)disulfide; a tri-substituted diphenyl disulfide such as bis(2,4,6-trichlorophenyl)disulfide, and bis(2-cyano-4-chloro-6-bromophenyl)disulfide; a tetra-substituted diphenyl disulfide such as bis(2,3,5,6-tetra chlorophenyl)disulfide; a penta-substituted diphenyl disulfide such as bis(2,3,4,5,6-pentachlorophenyl)disulfide and bis(2,3,4,5,6-pentabromophenyl)disulfide. These diphenyl disulfides or the derivative thereof can enhance resilience by having some influence on the state of vulcanization of vulcanized rubber. Among them, diphenyl disulfide and bis(pentabromophenyl) disulfide are preferably used, since a golf ball having particularly high resilience can be obtained. The amount of the organic sulfur compound to be blended is preferably 0.1 part by mass or more, more preferably 0. 3 part by mass or more, and preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the amount of the peptizing agent is preferably 0.1 part or more and is preferably 5 parts or less based on 100 parts of the base rubber by mass.

The conditions for press-molding the core rubber composition should be determined depending on the rubber composition. The press-molding is preferably carried out for 10 to 60 minutes at the temperature of 130 to 200° C. Alternatively, the press-molding is preferably carried out in a two-step heating, for example, for 20 to 40 minutes at the temperature of 130 to 150° C., and continuously for 5 to 15 minutes at the temperature of 160 to 180° C.

In the case that the core consists of a center and a single-layered intermediate layer covering the center and that the core consists of a center and multi-piece or multi-layer of intermediate layers covering the center, the center can be formed from the core rubber composition described above. The diameter of the center is preferably 30 mm or more, more preferably 32 mm or more, and is preferably preferably 41 mm or less, more preferably 40.5 mm or less. If the diameter of the center is less than 30 mm, the intermediate layer or the cover layer must be made thicker than the desired thickness, resulting in the lowered resilience. On the other hand, if the diameter of the center is more than 41 mm, the intermediate layer or the cover must be made thinner than the desired thickness, and hence the intermediate layer or the cover does not function well.

Examples of the material for the intermediate layer are a cured product of the rubber composition; an ionomer resin; a thermoplastic polyamide elastomer having a commercial name of "Pebax (registered trademark) (e.g. Pebax 2533)" available from Arkema; a thermoplastic polyester elastomer having a commercial name of "Hytrel (registered trademark) (e.g. Hytrel 3548, Hytrel 4047)" available from Du Pont-Toray Co., Ltd.; a thermoplastic polyurethane elastomer having a commercial name of "Elastollan (registered trademark) (e.g. Elastollan XNY97A)" available from BASF Japan Co., a thermoplastic polystyrene elastomer having a commercial name of "Rabalon (registered trademark) (e.g. Rabalon SR04, Rabalon T3339C, Rabalon T3221C)" available from Mitsubishi Chemical Corporation. As the ionomer resin, the ionomer resins exemplified as the material for the cover can be also used. The intermediate layer may further contain a specific gravity adjusting agent such as barium sulfate or tungsten or the like; an antioxidant; or a pigment component.

A method for molding the intermediate layer is not particularly limited, and includes an embodiment which comprises injection molding the intermediate layer composition directly onto the center, or an embodiment which comprises molding the intermediate layer composition into a half hollow-shell, covering the center with the two hollow-shells and subjecting the center with the two hollow-shells to the compression-molding.

In the case of using the intermediate layer composition containing a rubber composition as a main component (50 mass % or more), the intermediate layer preferably has a thickness of 1.2 mm or more, more preferably 1.8 mm or more, even more preferably 2.4 mm or more, and preferably has a thickness of 6.0 mm or less, more preferably 5.2 mm or less, even more preferably 4.4 mm or less.

In the case of using the intermediate layer composition containing the resin composition as a main component (50 mass % or more), the intermediate layer preferably has a thickness of 0.3 mm or more, more preferably 0.4 mm or more, even more preferably 0.5 mm or more, and preferably has a thickness of 2.5 mm or less, more preferably 2.4 mm or less, even more preferably 2.3 mm or less. If the thickness of the intermediate layer is more than 2.5 mm, the resilience performance of the obtained golf ball may be lowered, while if the thickness of the intermediate layer is less than 0.3 mm, it may be difficult to suppress the excessive spin rate on driver shots.

The intermediate layer of the golf ball of the present invention preferably has a slab hardness of 40 or larger, more preferably 45 or larger, and even more preferably 50 or larger, and preferably has a slab hardness of 80 or smaller, more preferably 70 or smaller, and even more preferably 65 or smaller in Shore D hardness. The intermediate layer having the slab hardness of 40 or more in shore D hardness makes the core have the higher degree of "hard outer and soft inner" structure, thereby providing a high launch angle and a less amount of spin and hence achieving a great flight distance of the gold ball. On the other hand, the intermediate layer having the slab hardness of 80 or less in shore D hardness provides an excellent shot feeling as well as improves the spin performance of the golf ball, thereby improving controllability of the golf ball. Herein, the slab hardness of the intermediate layer is the measured hardness of the intermediate layer composition molded in the form of a sheet, and is measured by a later-described measuring method. The slab hardness of the intermediate layer can be adjusted, for example, by appropriately selecting a combination of the above resin components or the rubber materials and the amount of additives.

The core used in the golf ball of the present invention preferably has a diameter of 39 mm or larger, more preferably 39.5 mm or larger, and even more preferably 40.8 mm or larger, and preferably has a diameter of 42.2 mm or smaller, more preferably 42 mm or smaller, and even more preferably 41.8 mm or smaller. If the diameter of the core is smaller than the above lower limit, the cover becomes so thick that the resulting golf ball would have reduced resilience. On the other hand, if the diameter of the core is larger than the above upper limit, the cover becomes so thin that it is difficult to mold a cover.

In a preferable embodiment, the core has a hardness difference between the center and the surface. The difference between the surface hardness and the center hardness is preferably 10 or more, more preferably 12 or more, and is preferably 40 or less, more preferably 35 or less, and even more preferably 30 or less in JIS-C hardness. If the hardness difference is more than 40, the durability may be lowered, while if the hardness difference is less than 10, the shot feeling may be hard because of a large impact. The surface hardness of the core is preferably 65 or more, more preferably 70 or more, even more preferably 72 or more, and is preferably 100 or less in JIS-C hardness. If the surface hardness of the core is less than 65 in JIS-C hardness, the core is so soft and the repulsion property may be lowered, resulting in the short flight distance. On the other hand, if the surface hardness of the core is more than 100, the core is so hard and the shot feeling may deteriorate. The center hardness of the core is preferably 45 or more, more preferably 50 or more, and is preferably 70 or less, and more preferably 65 or less in JIS-C hardness. If the center hardness of the core is less than 45, the core is so soft and the durability may be lowered, while if the center hardness of the core is more than 70, the core is so hard and the shot feeling may be worsened. The hardness difference of the core can be formed by properly selecting the heat molding conditions of the core or employing a multi-layered structure of the center and the intermediate layer. The center hardness of the core means a JIS-C hardness obtained by cutting a spherical core into halves and measuring at the central point of the cut surface using a JIS-C type spring hardness tester. The surface hardness means a hardness measured at a surface part of the spherical core using a JIS-C type spring hardness tester. In the case that the core has a multi-layered structure, the surface hardness of the core means the hardness measured at the surface of the outermost layer of the core.

The golf ball of the present invention is not particularly limited on a structure thereof as long as the golf ball has a core and a cover. Examples of the golf ball of the present invention include a two-piece golf ball including a core, and a cover covering the core; a three-piece golf ball including a core consisting of a center and an intermediate layer covering the center, and a cover covering the core; a multi-piece golf ball including a core consisting of a center and a multi-piece or multi-layer of intermediate layers covering the center, and a cover covering the core; and a wound golf ball including a wound core, and a cover covering the wound core.

When preparing a wound golf ball in the present invention, a wound core may be used as the core. In that case, for example, a wound core comprising a center formed by curing the above rubber composition for the core and a rubber thread layer which is formed by winding a rubber thread around the center in an elongated state can be used. In the present invention, the rubber thread, which is conventionally used for winding around the center, can be adopted for winding around the center. The rubber thread, for example, is obtained by vulcanizing a rubber composition including a natural rubber, or a mixture of a natural rubber and a synthetic polyisoprene, a sulfur, a vulcanization auxiliary agent, a vulcanization accelerator, and an antioxidant. The rubber thread is wound around the center in elongation of about 10 times length to form the wound core.

According to the present invention, it is possible to provide a golf ball which has a high spin rate on the approach shots and a low spin rate on the driver shots. The spin rate on the approach shots is preferably 6,500 rpm or more, more preferably 6,550 rpm or more. If the spin rate on the approach shots is 6,500 rpm or more, the golf ball stops quickly on the green on the approach shots. The upper limit of the spin rate on the approach shots is not limited, but if the spin rate on the approach shots is too high, the spin rate on the driver shots may also become high. From this aspect, the spin rate on the approach shots is preferably 8,000 rpm or less, more preferably 7,800 rpm or less. On the other hand, the spin rate on the driver shots is preferably 2,600 rpm or less, more preferably 2,580 rpm or less. If the spin rate on the driver shots is 2,600 rpm or less, since the spin rate becomes low, the golf ball traveling a great distance is obtained. In order to increase the flight distance on the driver shots, the certain degree of the spin rate is necessary. Thus, the spin rate on the driver shots is preferably 2,000 rpm or more, more preferably 2,100 rpm or more, even more preferably 2,200 rpm or more. The spin rates on the approach shots and the driver shots are determined by the method described later.

The method for producing a golf ball of the present invention comprises compression molding a cover composition containing a resin component and a filler to mold a shell, and compression molding a core covered with a plurality of shells to mold a cover. In a preferable embodiment, the method comprises compression molding a cover composition containing a resin component and a filler to mold a half shell, and compression molding a core covered with two half shells to mold a cover.

The cover composition may further contain a pigment component such as a white pigment (for example, titanium oxide) and a blue pigment, a gravity adjusting agent such as calcium carbonate and barium sulfate, a dispersant, an antioxidant, an ultraviolet absorber, a light stabilizer, a fluorescent material or a fluorescent brightener, in addition to the resin component described above and the filler.

Figure 4:
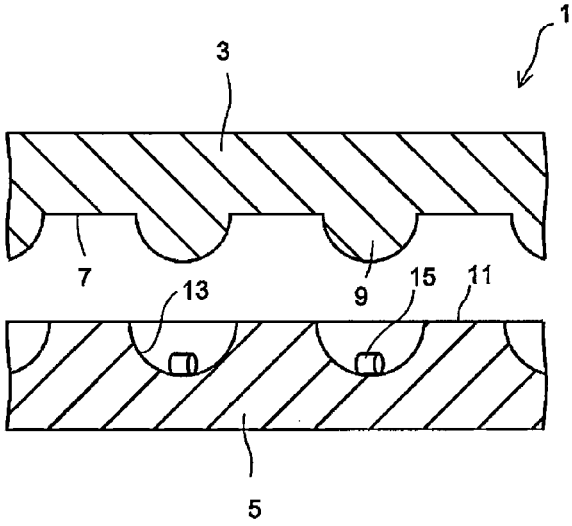
FIG. 4 is an explanatory illustration showing a method for molding a half shell.

In a method of manufacturing a golf ball of the present invention, half shells are formed by compression molding. For example, FIG. 4 is an explanatory illustration showing a method of molding a half shell by compression molding. A mold 1 for forming half shells includes an upper mold 3 and a lower mold 5. The upper mold 3 is provided with a flat part 7 and hemispherical projections 9, and the lower mold 5 is provided with a flat part 11 and hemispherical recesses 13. Compression molding of half shells can be conducted by charging a cover material 15 in the pellet form into each recess 13 of the lower mold 5, and clamping the upper mold 3 and the lower mold 5 using a pressing machine or the like. In this case, two or more pellets may be charged into each recess 13 of the lower mold 5. When two or more pellets are charged, a seam (weld line) occurs between the pellets in an obtained half shell. Since a weld line has a possibility of reducing the durability of the obtained cover, the number of the pellets charged into each recess 13 of the lower mold 5 is preferably one. In this respect, the mass per pellet is preferably 1.4 g or more and 2.0 g or less. When the mass per pellet falls within the range from 1.4 g to 2.0 g, one half shell can be formed from one pellet. Further, if the number of pellets charged into one recess is one, the operation for charging pellets becomes easy.

The compression molding of the cover composition into half shell is preferably carried out under a pressure of 1 MPa or more, more preferably 2 MPa or more, and is preferably carried out under a pressure of 20 MPa or less, more preferably 15 MPa or less. If the molding pressure falls within the range from 1 MPa to 20 MPa, a half shell having a uniform thickness can be formed.

The compression molding of the cover composition into half shell is preferably carried out at a temperature of −20° C. or more, more preferably −10° C. or more, and is preferably carried out at a temperature of 70° C. or less, more preferably 60° C. or less, even more preferably 50° C. or less relative to the flow beginning temperature of the cover composition. If the molding temperature is 70° C. or less relative to the flow beginning temperature of the cover composition, the durability and the abrasion resistance of the cover improve. If the molding temperature is −20° C. or more relative to the flow beginning temperature of the cover composition, the moldability improves.

The molding temperature means the highest temperature where the temperature at the surface of the concave portion of the lower mold reaches from closing through opening the molds. Further, the flow beginning temperature of the cover material can be measured in a pellet form under the following conditions by using a flow characteristics evaluation apparatus (Flow Tester CFT-500, manufactured by Shimadzu Corporation).

Measuring conditions: Area size of a plunger: 1 $cm^2$, Die length: 1 mm, Die diameter: 1 mm, Load: 588.399 N, Start temperature: 30° C., and Temperature increase rate: 3° C./min.

The compression molding of the cover composition into half shell is preferably carried out for 30 minutes or less, more preferably 20 minutes or less, even more preferably 10 minutes or less, even more preferably 5 minutes or less. If the molding time is too long, the thermal decomposition of the polyurethane proceeds, which may result in the lower durability and abrasion resistance of the obtained cover. The molding time is preferably 1 minute or more, more preferably 2 minutes or more. For the molding time about 1 minute, the cover material in the form of the pellet flows in the mold, and the half shell can be molded. The molding time means a time from closing to opening the molds.

Figure 5:
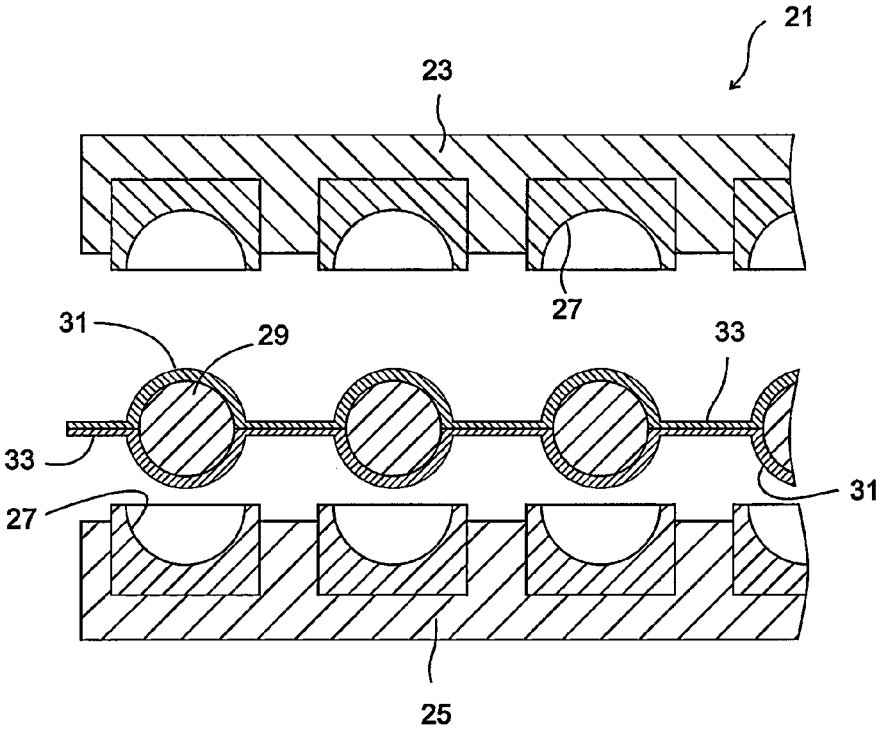
FIG. 5 is an explanatory illustration showing a method for molding a cover from half shells.

Examples of a method of forming a cover using the half shells produced as described above, include a method of compression molding a core covered with two half shells. FIG. 5 is an explanatory illustration showing a method of compression molding a core covered with two half shells. A mold 21 for forming covers (for compression molding) includes an upper mold 23 and a lower mold 25. Each of the upper mold 23 and the lower mold 25 has many cavity surfaces 27, thereby forming hemispherical cavities. After each core 29 is covered with two half shells 31, the obtained covered body is placed into the cavity of the lower mold 25, and the mold 21 is clamped using a pressing machine or the like, to form a cover. In the example shown in FIG. 5, half shells 31 are connected by a flat part 33 formed from the cover material. Although not shown in the drawing, many pimples are formed on each cavity surface, and dimples having a shape which is the inverted shape of the pimples are formed on the surface of the cover.

The compression molding of the half shells into the cover is preferably carried out at a temperature of −20° C. or more, more preferably −10° C. or more, and is preferably carried out at a temperature of 70° C. or less, more preferably 60° C. or less, even more preferably 50° C. or less relative to the flow beginning temperature of the cover composition. If the molding temperature is 70° C. or less relative to the flow beginning temperature of the cover composition, the durability and the abrasion resistance of the cover improve. If the molding temperature is −20° C. or more relative to the flow beginning temperature of the cover composition, the moldability improves.

The compression molding of the half shells into the cover is preferably carried out under a pressure of 0.5 MPa or more, more preferably 1 MPa or more, and is preferably carried out under a pressure of 25 MPa or less, more preferably 15 MPa or less. If the molding pressure falls within the range from 0.5 MPa to 25 MPa, a half shell having a uniform thickness can be formed.

The compression molding of the half shells into the cover is preferably carried out for 30 minutes or less, more preferably 20 minutes or less, even more preferably 10 minutes or less, even more preferably 5 minutes or less. If the molding time is too long, the thermal decomposition of the polyurethane proceeds, which may result in the lower durability and abrasion resistance of the obtained cover. The molding time is preferably 1 minute or more, more preferably 2 minutes or more. For the molding time about 1 to 2 minutes, it is possible to mold the cover from half shells. The molding time means a time from closing to opening the molds.

After the cover is molded, the mold is opened and the golf ball body is taken out from the mold, and as necessary, the golf ball body is preferably subjected to surface treatments such as deburring, cleaning, and sandblast. If desired, a paint film or a mark may be formed.

When molding a cover, the concave portions called "dimple" are usually formed on the surface. After the cover is molded, the mold is opened and the golf ball body is taken out from the mold, and as necessary, the golf ball body is preferably subjected to surface treatments such as deburring, cleaning, and sandblast. If desired, a paint film or a mark may be formed. The paint film preferably has a thickness of, but not limited to, 5 μm or larger, and more preferably 7 μm or larger, and preferably has a thickness of 25 μm or smaller, and more preferably 18 μm or smaller. If the thickness is smaller than 5 μm, the paint film is easy to wear off due to continued use of the golf ball, and if the thickness is larger than 25 μm, the effect of the dimples is reduced, resulting in lowering flying performance of the golf ball.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

[Evaluation Methods]

(1) Spin Rate on the Approach Shots

An approach wedge (SRIXON I-302, Shaft S available from SRI Sports Limited) was installed on a swing robot available from Golf Laboratories, Inc. A golf ball was hit at a head speed of 21 m/sec., and a sequence of photographs of the hit golf ball were taken for measuring the spin rate (rpm). The measurement was performed ten times for each golf ball, and the average value is regarded as the spin rate (rpm).

(2) Spin Rate on the Driver Shots

A driver (XXIO, shaft S, Loft angle: 11° available from SRI Sports Limited) was installed on a swing robot available from Golf Laboratories, Inc. A golf ball was hit at a head speed of 50 m/sec., and a sequence of photographs of the hit golf ball were taken for measuring the spin rate (rpm). The measurement was performed ten times for each golf ball, and the average value is regarded as the spin rate (rpm).

(3) Slab Hardness (Shore D Hardness)

Sheets having a thickness of about 2 mm were prepared from, polyurethane, the cover composition or the intermediate layer composition by hot press molding and preserved at the temperature of 23° C. for two weeks. Three or more of the sheets were stacked on one another to avoid being affected by the measuring substrate on which the sheets were placed, and the stack was subjected to the measurement using a P1 type auto hardness tester provided with the Shore D type spring hardness tester prescribed by ASTM-D2240, available from KOUBUNSHI KEIKI CO., LTD to obtain the respective slab hardness of the polyurethane, the cover composition or the intermediate layer composition.

(4) Core Hardness (JIS-C)

The hardness measured at a surface part of a spherical core using a P1 type auto hardness tester provided with a JIS-C type spring hardness tester available from KOUBUNSHI KEIKI CO., LTD, was determined as the surface hardness of the spherical core, and the JIS-C hardness obtained by cutting a spherical core into halves and measuring at the central point of the cut surface was determined as the center hardness of the spherical core.

(5) Orientation of the Filler

Samples (10 mm×10 mm) were cut out of the half shell, and analyzed with Spectrum one FT-IR (using universal ATR accessory (diamond crystal)) manufactured by Perkin ELMER by ATR method. From the obtained FT-IR spectrum, absorbance (A1100) at 1100 $cm^{-1}$ and absorbance (A1030) at 1030 $cm^{-1}$ were determined respectively, and the degree of orientation (A1100/A1030) was calculated.

[Production of the Golf Ball]

(1) Preparation of the Center

The center rubber composition having formulation shown in Table 1 was kneaded and pressed in upper and lower molds, each having a hemispherical cavity, at a temperature of 170° C. for 15 minutes to obtain the spherical center having a diameter of 38.5 mm and a weight of 34.9 g.

TABLE 1

| Center composition | Parts |
|---|---|
| Polybutadiene rubber | 100 |
| Zinc acrylate | 35 |
| Zinc oxide | 5 |
| Diphenyl disulfide | 0.5 |
| Dicumyl peroxide | 1 |
| Center hardness of the Center (Shore D) | 40 |

Notes on table 1:
Parts by mass
Polybutadiene rubber: "BR730 (high cis-polybutadiene)" manufactured by JSR Corporation
Zinc acrylate: "ZNDA-90S" manufactured by NIHON JYORYU KOGYO Co,. LTD.
Zinc oxide: "Ginrei R" manufactured by Toho-Zinc Co.
Dicumyl peroxide: "Percumyl D" manufactured by NOF Corporation
Diphenyl disulfide: manufactured by Sumitomo Seika Chemicals Company Limited (2) Preparation of Core The blending materials shown in Table 2 were extruded by a twin-screw kneading extruder to prepare an intermediate layer composition in the form of pellet. Extrusion was performed in the following conditions: screw diameter=45 mm; screw revolutions=200 rpm; and screw L/D=35. The mixtures were heated to a temperature ranging from 150° C. to 230° C. at a die position of the extruder. The obtained intermediate layer composition was injection molded on the center which had been obtained as described above, to prepare a core consisting of the center and the intermediate layer (thickness: 1.6 mm) covering the center.

TABLE 2

| Intermediate layer composition | Part by mass |
|---|---|
| Himilan 1605 | 50 |
| Himilan AM7329 | 50 |
| Slab hardness (shore D) of intermediate layer | 64 |

TABLE 2-continued

| Intermediate layer composition | Part by mass |
|---|---|
| Surface hardness of Core (JIS-C hardness) | 98 |
| Center hardness of Core (JIS-C hardness) | 65 |

Notes on table 2:
Himilan 1605: sodium ion neutralized ethylene-methacrylic acid copolymerized ionomer resin manufactured by MITSUI-DUPONT POLYCHEMICAL CO., LTD.
Himilan AM7329: zinc ion neutralized ethylene-methacrylic acid copolymerized ionomer resin manufactured by MITSUI-DUPONT POLYCHEMICAL CO., LTD.

(3) Preparation of Cover Composition.

As the blending ratios shown in tables No. 3 to 5, the polyurethane and the flake-like filler were blended to prepare the cover composition in the form of the pellet. The polyurethane was kneaded for 2 minutes using a dispersion mixing tester MIX-LABO manufactured by MORIYMA Company Ltd. Then, the flake like filler was added and the mixture was kneaded for 3 minutes. Blending was carried out at a temperature of 180° C. and at a revolution of 100 rpm.

(4) Molding of Half Shells

With respect to the golf balls No. 1 to No. 22, half shells were produced by compression molding method. Compression molding of half shells were performed by, charging one pellet of the cover composition obtained as described above into each of depressed parts of lower molds for molding half shells, and applying pressure to mold half shells. Compression molding was performed at a temperature of 170° C. for 5 minutes under a molding pressure of 2.94 MPa. With respect to the golf balls No. 22 to 25, half shells were produced by injection molding method. Injection molding was carried out under the conditions of molding temperature: 210° C., molding pressure: 12 MPa, and molding time: 0.5 second.

(5) Molding of the Cover

The core obtained in (2) was covered with the two half shells obtained in (4) in a concentric manner, and the cover (thickness: 0.5 mm) was molded by compression molding. Compression molding was performed at a temperature of 145° C. for 2 minutes under a molding pressure of 9.8 MPa. The surface of the obtained golf ball body was subjected to a sandblast treatment, and marking, and then clear paint was applied thereto and dried in an oven at a temperature of 40° C. to obtain a golf ball having a diameter of 42.7 mm and a weight of 45.3 g. The performance of the obtained golf ball was evaluated, and results thereof are also shown in Tables 3 to 5.

TABLE 3

| | | Golf ball No. | | | | | |
|---|---|---|---|---|---|---|---|
| | | 1 | 2 | 3 | 4 | 5 | 6 |
| Cover composition | Elastollan XNY-68A | — | — | — | — | — | — |
| | Elastollan XNY-70A | — | — | — | — | — | 100 |
| | Elastollan XNY-75A | 100 | — | — | — | — | — |
| | Elastollan XNY-83A | — | 100 | — | — | — | — |
| | Elastollan XNY-85A | — | — | 100 | — | — | — |
| | Elastollan XNY-90A | — | — | — | 100 | — | — |
| | Eelastollan XNY-97A | — | — | — | — | 100 | — |
| | Flake-like filler | 10 | 10 | 10 | 10 | 10 | 20 |
| | Titanium oxide | 4 | 4 | 4 | 4 | 4 | 4 |
| | Slab hardness (Shore D) | 33 | 38 | 44 | 47 | 51 | 34 |
| Cover | Molding method of half shell | Comp. | Comp. | Comp. | Comp. | Comp. | Comp. |
| | A1100 | 0.4475 | 0.4415 | 0.43331 | 0.41164 | 0.31693 | 0.416 |
| | A1030 | 0.36722 | 0.36596 | 0.34826 | 0.35973 | 0.30971 | 0.45006 |
| | Orientation Degree (A1100/A1030) | 1.21862 | 1.20643 | 1.24422 | 1.1443 | 1.02333 | 0.92432 |
| Ball | Spin rate on Approach shots (rpm) | 6935 | 6678 | 6500 | 6517 | 6108 | 6939 |
| | Spin rate on Driver shots (rpm) | 2556 | 2460 | 2342 | 2326 | 2172 | 2492 |

TABLE 3-continued

| | | | Golf ball No. | | | | |
|---|---|---|---|---|---|---|---|
| | | | 7 | 8 | 9 | 10 | 11 |
| | Cover composition | Elastollan XNY-68A | — | — | — | — | — |
| | | Elastollan XNY-70A | — | — | — | — | — |
| | | Elastollan XNY-75A | 100 | — | — | — | — |
| | | Elastollan XNY-83A | — | 100 | — | — | — |
| | | Elastollan XNY-85A | — | — | 100 | — | — |
| | | Elastollan XNY-90A | — | — | — | 100 | — |
| | | Eelastollan XNY-97A | — | — | — | — | 100 |
| | | Flake-like filler | 20 | 20 | 20 | 20 | 20 |
| | | Titanium oxide | 4 | 4 | 4 | 4 | 4 |
| | | Slab hardness (Shore D) | 39 | 43 | 45 | 47 | 53 |
| | Cover | Molding method of half shell | Comp. | Comp. | Comp. | Comp. | Comp. |
| | | A1100 | 0.41456 | 0.41356 | 0.411633 | 0.2948 | 0.39618 |
| | | A1030 | 0.45 | 0.44966 | 0.43398 | 0.33005 | 0.4492 |
| | | Orientation Degree (A1100/A1030) | 0.92124 | 0.91972 | 0.94852 | 0.8932 | 0.88196 |
| | Ball | Spin rate on Approach shots (rpm) | 6708 | 6532 | 6400 | 6349 | 6042 |
| | | Spin rate on Driver shots (rpm) | 2400 | 2360 | 2359 | 2261 | 2217 |

Formulation: parts by mass

Molding method of half shell: Comp; Compression molding, Inject; Injection molding

TABLE 4

| | | Golf ball No. | | | | | |
|---|---|---|---|---|---|---|---|
| | | 12 | 13 | 14 | 15 | 16 | 17 |
| Cover composition | Elastollan XNY-68A | 100 | — | — | — | — | — |
| | Elastollan XNY-70A | — | 100 | — | — | — | — |
| | Elastollan XNY-75A | — | — | — | — | — | — |
| | Elastollan XNY-83A | — | — | 100 | — | — | — |
| | Elastollan XNY-85A | — | — | | 100 | — | — |
| | Elastollan XNY-90A | — | — | — | — | 100 | — |
| | Elastollan XNY-97A | — | — | — | — | — | 100 |
| | Flake-like filler | 40 | 40 | 40 | 40 | 40 | 40 |
| | Titanium oxide | 4 | 4 | 4 | 4 | 4 | 4 |
| | Slab hardness (Shore D) | 32 | 37 | 44 | 49 | 52 | 57 |
| Cover | Molding method of half shell | Comp. | Comp. | Comp. | Comp. | Comp. | Comp. |
| | A1100 | 0.40652 | 0.40556 | 0.40457 | 0.36085 | 0.37993 | 0.36359 |
| | A1030 | 0.58774 | 0.58622 | 0.58282 | 0.52475 | 0.59032 | 0.54384 |
| | Orientation Degree (A1100/A1030) | 0.69167 | 0.69182 | 0.69416 | 0.68766 | 0.64360 | 0.66856 |
| Ball | Spin rate on Approach shots (rpm) | 6943 | 6712 | 6303 | 5998 | 5866 | 5852 |
| | Spin rate on Driver shots (rpm) | 2430 | 2375 | 2382 | 2265 | 2276 | 2318 |

Formulation: parts by mass

Molding method of half shell: Comp; Compression molding, Inject; Injection molding

TABLE 5

| | | Golf ball No. | | | | | | | |
|---|---|---|---|---|---|---|---|---|---|
| | | 18 | 19 | 20 | 21 | 22 | 23 | 24 | 25 |
| Cover composition | Elastollan XNY-83A | 100 | — | — | — | 100 | — | — | — |
| | Elastollan XNY-85A | — | 100 | — | — | — | 100 | — | — |
| | Elastollan XNY-90A | — | — | 100 | | — | — | 100 | — |
| | Elastollan XNY-97A | — | — | — | 100 | — | — | — | 100 |
| | Flake-like filler | 0 | 0 | 0 | 0 | 40 | 40 | 40 | 40 |
| | Titanium oxide | 4 | 4 | 4 | 4 | 4 | 4 | 4 | 4 |
| | Slab hardness (Shore D) | 31 | 38 | 41 | 49 | 44 | 49 | 52 | 57 |
| Cover | Molding method of half shell | Comp. | Comp. | Comp. | Comp. | Inject. | Inject. | Inject. | Inject. |
| | A1100 | 0.49194 | 0.47538 | 0.46876 | 0.44566 | 0.492130 | 0.474880 | 0.469052 | 0.445570 |
| | A1030 | 0.24387 | 0.25108 | 0.25926 | 0.28236 | 0.243992 | 0.250099 | 0.25997 | 0.281959 |
| | Orientation Degree (A1100/A1030) | 2.01722 | 1.89333 | 1.80808 | 1.57837 | 2.01699 | 1.89877 | 1.80425 | 1.58027 |

TABLE 5-continued

| | | Golf ball No. | | | | | | | |
|---|---|---|---|---|---|---|---|---|---|
| | | 18 | 19 | 20 | 21 | 22 | 23 | 24 | 25 |
| Ball | Spin rate on Approach shots (rpm) | 6938 | 6710 | 6495 | 6365 | 6489 | 6323 | 6223 | 6060 |
| | Spin rate on Driver shots (rpm) | 2649 | 2482 | 2370 | 2254 | 2341 | 2235 | 2169 | 2058 |

Figure 6:
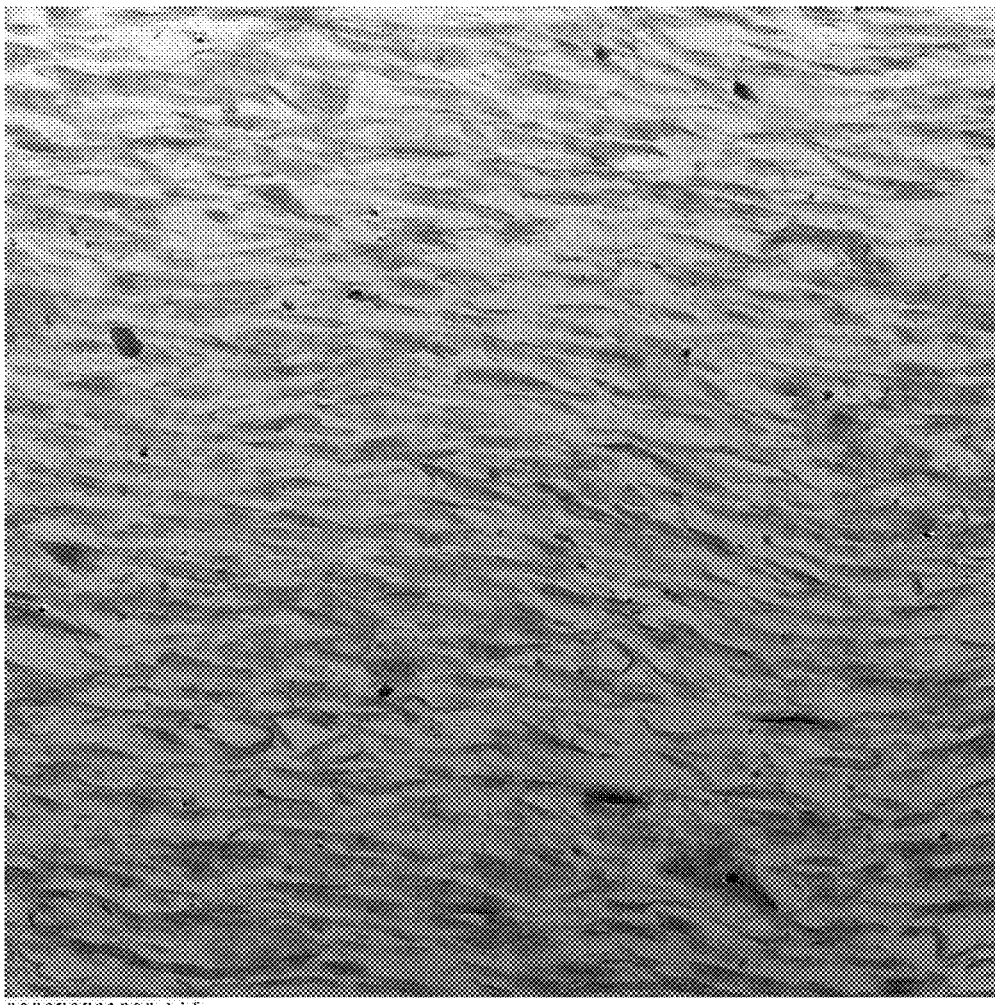
FIG. 6 is a photograph showing an example of the orientation of the flake-like filler in the golf ball of the present invention.

Formulation: parts by mass
Molding method of half shell: Comp; Compression molding, Inject; Injection molding Elastollan XNY-68A: thermoplastic polyurethane elastomer available from BASF Japan Co.
Elastollan XNY-70A: thermoplastic polyurethane elastomer available from BASF Japan Co.
Elastollan XNY-75A: thermoplastic polyurethane elastomer available from BASF Japan Co.
Elastollan XNY-83A: thermoplastic polyurethane elastomer available from BASF Japan Co.
Elastollan XNY-85A: thermoplastic polyurethane elastomer available from BASF Japan Co.
Elastollan XNY-90A: thermoplastic polyurethane elastomer available from BASF Japan Co.
Elastollan XNY-97A: thermoplastic polyurethane elastomer available from BASF Japan Co.
Flake like filler: S-BEN NO12 available from HOJUN Co., Ltd Golf balls Nos. 1 to 17 are golf balls produced by compression molding a cover composition containing a resin component and a flake-like filler to form half shells. From tables 3 and 4, the orientation degrees (A1100/A1030) of golf balls Nos. 1 to 17 are low, which indicates that the filler in the cover is oriented roughly parallel to the cover surface. FIG. 6 is a photograph showing a cross section of the half shell of golf ball No. 17. The half shell is compressed in the top to down direction of the photograph, and it is observed that the flake-like filler is orientated roughly parallel to the cover surface. On the other hand, in golf balls Nos. 22 to 25 produced by injection molding a cover composition containing a resin component and a flake-like filler to produce half shells, the orientation degree (A1100/A1030) is high, and thus it is thought that the filler is oriented at random in the cover.

Figure 7:
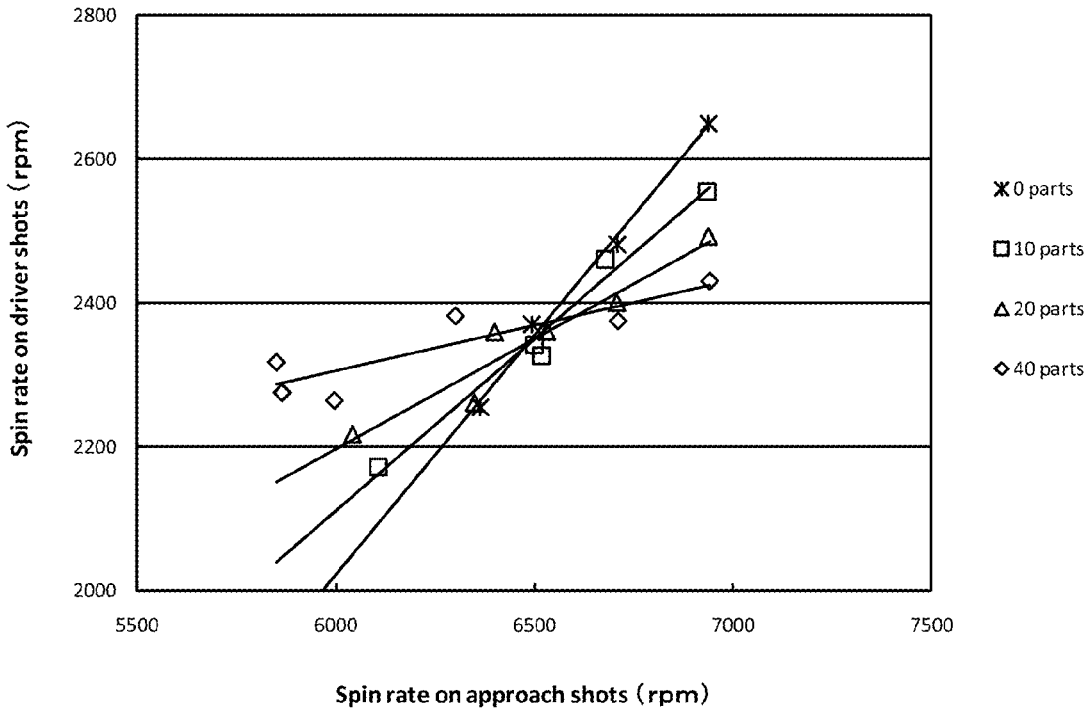
FIG. 7 is a graph showing a correlation between the spin rate on the approach shots and the spin rate on the driver shots.

Golf balls Nos. 1 to 5, Nos. 6 to 11, Nos. 12 to 17, and Nos. 18 to 21 are in the cases where the amounts of the flake-like filler are 10 parts by mass, 20 parts by mass, 40 parts by mass, and 0 parts by mass, respectively, with respect to 100 parts by mass of the polyurethane of the cover composition. For each case, the correlation between the spin rate on approach shots and the spin rate on driver shots is shown in FIG. 7. The approximate expressions of approximated curves in FIG. 7 and the amounts of the flake-like filler are shown in Table 6. From these results, it is found that, since the slopes of the approximated curves for golf balls Nos. 1 to 17 of the present invention are less than 0.5, the increase in the spin rate on driver shots is less than 50% of the increase in the spin rate on approach shots. Thus, by taking advantage of this material characteristic, it is possible to increase the spin rate on the approach shots while controlling the increase in the spin rate on the driver shots. On the other hand, when no filler is used, the slope of the approximated curve is 0.7, and it is found that the increase in the spin rate on driver shots is 70% of the increase in the spin rate on approach shots. If these kinds of materials are used, increasing the spin rate on the approach shots also increase the spin rate on the driver shots, which leads to the short flight distance. Although golf balls Nos. 22 to 25 are the cases where half shells were produced by injection molding (corresponding to the golf ball disclosed in Japanese Patent Publication No. 2006-43447), similarly, the increase in the spin rate on driver shots becomes great with respect to the increase in the spin rate on approach shots. From these results, it is found that a golf ball which has a high spin rate on approach shots and a low spin rate on driver shots is obtained by making the filler in the cover to be oriented roughly parallel to the cover surface.

TABLE 6

| Blending amount of flake-like filler (parts by mass) | Approximate expression |
|---|---|
| 0 | Y = 0.6667X − 1979.4 |
| 10 | Y = 0.473X − 753.93 |
| 20 | Y = 0.3055X + 364.05 |
| 40 | Y = 0.1252X + 1554.8 |

Y: Spin rate on the driver shots (rpm)
X: Spin rate on the approach shots (rpm)

According to the present invention, it is possible to control the spin rate on the approach shots while suppressing the change in the spin rate on the driver shots. By taking advantage of this characteristic, it is possible to provide a golf ball having a high spin rate on the approach shots and a low spin rate on the driver shots. This application is based on Japanese Patent application No. 2009-248651 filed on Oct. 29, 2009, the contents of which are hereby incorporated by reference.

What is claimed is:

1. A golf ball having a cover containing a resin component and a filler, wherein the cover contains the filler in an amount ranging from 10 parts to 100 parts by mass with respect to 100 parts by mass of the resin component, wherein the filler is oriented roughly parallel to a surface of the cover, and wherein a ratio (A1100/A1030) of an absorbance at 1100 $cm^{-1}$ to an absorbance at 1030 $cm^{-1}$ is 1.3 or less in an infrared spectrum of the cover.

2. The golf ball according to claim 1, wherein the filler is a flake-like filler and a face of the flake-like filler is oriented roughly parallel to the surface of the cover.

3. The golf ball according to claim 1, wherein the filler is a layered silicate or an organically modified layered silicate.

4. The golf ball according to claim 3, wherein each layer constituting the layered silicate or organically modified silicate has a thickness of 10 nm or less.

5. The golf ball according to claim 3, wherein each layer constituting the layered silicate or organically modified silicate has a flat shape with a length of 1 μm or less and a width of 1 μm or less.

6. The golf ball according to claim 3, wherein the layered silicate has a cation exchange capacity ranging from 30 meq/100 g to 200 meq/100 g.

7. The golf ball according to claim 3, wherein the organically modified silicate has an ion exchange rate of 50 mole % or more.

8. The golf ball according to claim 1, wherein the cover has a slab hardness ranging from 20 to 80 in Shore D hardness.

9. The golf ball according to claim 1, wherein the cover has a thickness ranging from 0.3 mm to 2 mm.

10. The golf ball according to claim 1, wherein the golf ball has a multi-layered core having a center and at least one intermediate layer covering the center.

11. The golf ball according to claim 10, wherein the intermediate layer has a thickness ranging from 0.3 mm to 6.0 mm and a slab hardness ranging from 40 to 80 in Shore D hardness.

12. The golf ball according to claim 10, wherein the core has a hardness difference ranging from 10 to 40 in JIS-C hardness between a surface hardness and a center hardness thereof.

13. The golf ball according to claim 10, wherein the core has a surface hardness ranging from 65 to 100 and a center hardness ranging from 45 to 70 in JIS-C hardness.

14. The golf ball according to claim 1, wherein the resin component contains polyurethane as a main component.

15. A method for producing a golf ball, comprising compression molding a cover composition containing a resin component and a filler to mold a shell, wherein the cover composition contains the filler in an amount ranging from 10 parts to 100 parts by mass with respect to 100 parts by mass of the resin component and compression molding a core covered with a plurality of shells to mold a cover wherein a ratio (A1100/A1030) of an absorbance at 1100 $cm^{-1}$ to an absorbance at 1030 $cm^{-1}$ is 1.3 or less in an infrared spectrum of the cover.

16. The method for producing the golf ball according to claim 15, wherein the filler is a flake-like filler.

17. The method for producing the golf ball according to claim 15, wherein the filler is a layered silicate or an organically modified layered silicate.

18. The method for producing the golf ball according to claim 15, wherein molding of the shell is conducted by charging one pellet of the cover composition with a mass from 1.4 g to 2.0 g into a depressed part of a lower mold and clamping an upper mold and the lower mold.

* * * * *